US006416221B2

(12) United States Patent
Price

(10) Patent No.: US 6,416,221 B2
(45) **Date of Patent: *Jul. 9, 2002**

(54) THERMOPLASTIC BAG WITH OFFSET FASTENER

(75) Inventor: William D. Price, Midland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/736,737

(22) Filed: Dec. 14, 2000

Related U.S. Application Data

(62) Division of application No. 08/918,082, filed on Aug. 25, 1997, now Pat. No. 6,213,641.

(51) Int. Cl.[7] ..... B65D 33/16

(52) U.S. Cl. ..... 383/63; 383/119; 229/117.27; 229/117.33

(58) Field of Search ..... 383/63, 64, 104, 383/119, 120; 229/117.27, 117.35, 117.33; 220/495.03, 495.06

(56) References Cited

U.S. PATENT DOCUMENTS

| | | | | |
|---|---|---|---|---|
| 2,378,503 A | | 6/1945 | Rohdin | |
| 3,367,380 A | | 2/1968 | Dickey | |
| 4,759,642 A | | 7/1988 | Van Erden et al. | |
| 4,877,336 A | | 10/1989 | Peppiatt | |
| 5,080,253 A | | 1/1992 | Zieke | |
| 5,080,497 A | | 1/1992 | Peppiatt | |
| 5,113,555 A | * | 5/1992 | Wilson et al. | 383/63 X |
| 5,211,482 A | | 5/1993 | Tilman | |
| RE34,347 E | | 8/1993 | VanErden et al. | |
| 5,275,491 A | | 1/1994 | Kuge | |
| 5,480,230 A | | 1/1996 | May | |
| 5,725,309 A | | 3/1998 | Robinson | |
| 5,788,378 A | * | 8/1998 | Thomas | 383/63 |
| 5,941,643 A | * | 8/1999 | Linkiewicz | 383/63 X |
| 6,007,246 A | * | 12/1999 | Kinigakis et al. | 383/63 X |
| 6,092,933 A | * | 7/2000 | Treu | 383/906 X |
| 6,206,571 B1 | * | 3/2001 | Olin | 383/906 X |
| 6,213,641 B1 | * | 4/2001 | Price | 383/63 |

FOREIGN PATENT DOCUMENTS

| | | |
|---|---|---|
| DE | 2752489 | 5/1979 |
| DE | 31 19179 A1 | 12/1982 |
| DE | 39 25 981 A1 | 2/1991 |
| JP | 0240650 | 10/1991 |
| JP | 0240651 | 10/1991 |
| JP | 405147661 | 6/1993 |

* cited by examiner

*Primary Examiner*—Jes F. Pascua
(74) *Attorney, Agent, or Firm*—S.C. Johnson Home Storage, Inc.

(57) ABSTRACT

A reclosable thermoplastic bag having an offset fastener. The bag includes first and second sidewalls, each having a top, a bottom and two opposing side edges, the first and second sidewalls being attached together along the respective bottom and side edges; an inwardly folded top pleat positioned across the first sidewall; a reclosable fastener having at least two cooperating closure members, one closure member being positioned proximate to the top of the first sidewall above the pleat, the other closure member being positioned proximate to the top of the second sidewall, such that when the bag is filled and closed, the reclosable fastener is offset.

2 Claims, 5 Drawing Sheets

THERMOPLASTIC BAG WITH OFFSET FASTENER

This application is a division of Ser. No. 08/918,082 filed Aug. 25, 1997 now U.S. Pat. No. 6,213,641.

BACKGROUND

The present invention relates to a reclosable thermoplastic bag.

Reclosable thermoplastic bags have a wide variety of applications, most notably in the food industry. The bags typically comprise two opposing sidewalls attached together along the side edges and bottom to form the sides and bottom of the bag. The bags also include a reclosable fastener along the tops of the sidewalls, or the mouth of the bag. Sometimes there is a pleat in the bottom of the bag which helps expand the volume available for storage.

Typically, the reclosable fastener extends along the centerline of the mouth of the bag. That is, when viewed from the top of the bag, the reclosable fastener would be positioned directly across the center. However, when the bag is filled and closed, the reclosable fastener along the centerline of the mouth tends to stick out past the side edges of the bag. This presents a problem when the bag is inserted into a secondary container such as a box, as the fastener sticks out too far, so that the bag does not easily fit into a close-fitting container.

Some modifications have been made in order to make the bags more suitable as liners. For example, U.S. Pat. No. Re. 34,317, issued to Van Erden et al., describes a bag having chamfer seals at the four corners of the bag, such that the four corners are freed from interfering with easy reception and packaging of the filled bag in a fairly close fitting carton. Another example is U.S. Pat. No. 5,275,491, issued to Kuge et al., which describes a bag that has inward folds extending vertically down along the side edges of the bag. Moreover, U.S. Pat. No. 5,080,253, issued to Zieke describes a cropped or chamfered top section of the bag as well as pleats along the sides of the bag. A problem with such modifications to the fastener is that when the bag mouth is opened, the available area is restricted, making it relatively difficult to fill the bags.

In the above mentioned reclosable bags, the reclosable fastener is disposed along the centerline of the mouth of the bag. The problem with such fasteners disposed along the centerline is that when the bag is filled, the fasteners stick out from the sides of the bag, making the bags undesirable as liners for close-fitting is containers. That is, in order to use such bags as liners for containers, the containers must be larger than necessary in order to permit the fastener to fit inside the container, thereby wasting space inside the container. Furthermore, if the fastener is cut so that it does not stick out, then the bag becomes difficult to fill because the mouth opening is restricted. It would be an advance in the art of reclosable thermoplastic bags to provide a bag which can conveniently be used as a liner for a close-fitting container while still maintaining a relatively unrestricted mouth opening when the bag is opened.

SUMMARY OF THE INVENTION

The present invention provides an alternative to the bags of the prior art. In one aspect, the present invention is a reclosable thermoplastic bag comprising first and second sidewalls, each having a top, a bottom and two opposing side edges, the first and second sidewalls being attached together along the side edges and proximate to the bottom; an inwardly folded top pleat positioned across the first sidewall; a reclosable fastener having at least two cooperating closure members, one closure member being positioned proximate to the top of the first sidewall above the pleat, the other closure member being positioned proximate to the top of the second sidewall, such that when the bag is filled and closed, the reclosable fastener is offset.

In a second aspect, the present invention is a reclosable thermoplastic bag comprising two sidewalls, each having a top, a bottom and two opposing side edges, the sidewalls being attached together along the side edges and proximate to the bottom; a top inwardly folded pleat extending laterally between the side edges in one of the sidewalls; a reclosable fastener positioned proximate to the top of the sidewalls above the pleat, such that when the bag is filled and the reclosable fastener is closed, the reclosable fastener is offset.

An important advantage of the bag of the present invention is that the reclosable fastener is offset, such that it extends along the perimeter of the bag rather than along the centerline. As a result, the reclosable fastener does not stick out from the sides of the bag and does not need to be cut in order to fit inside a close-fitting container. This permits better use of the bag as a liner while still maintaining the full area of the mouth opening to be available for filling the bag.

DETAILED DESCRIPTION OF THE INVENTION

Figure 1:
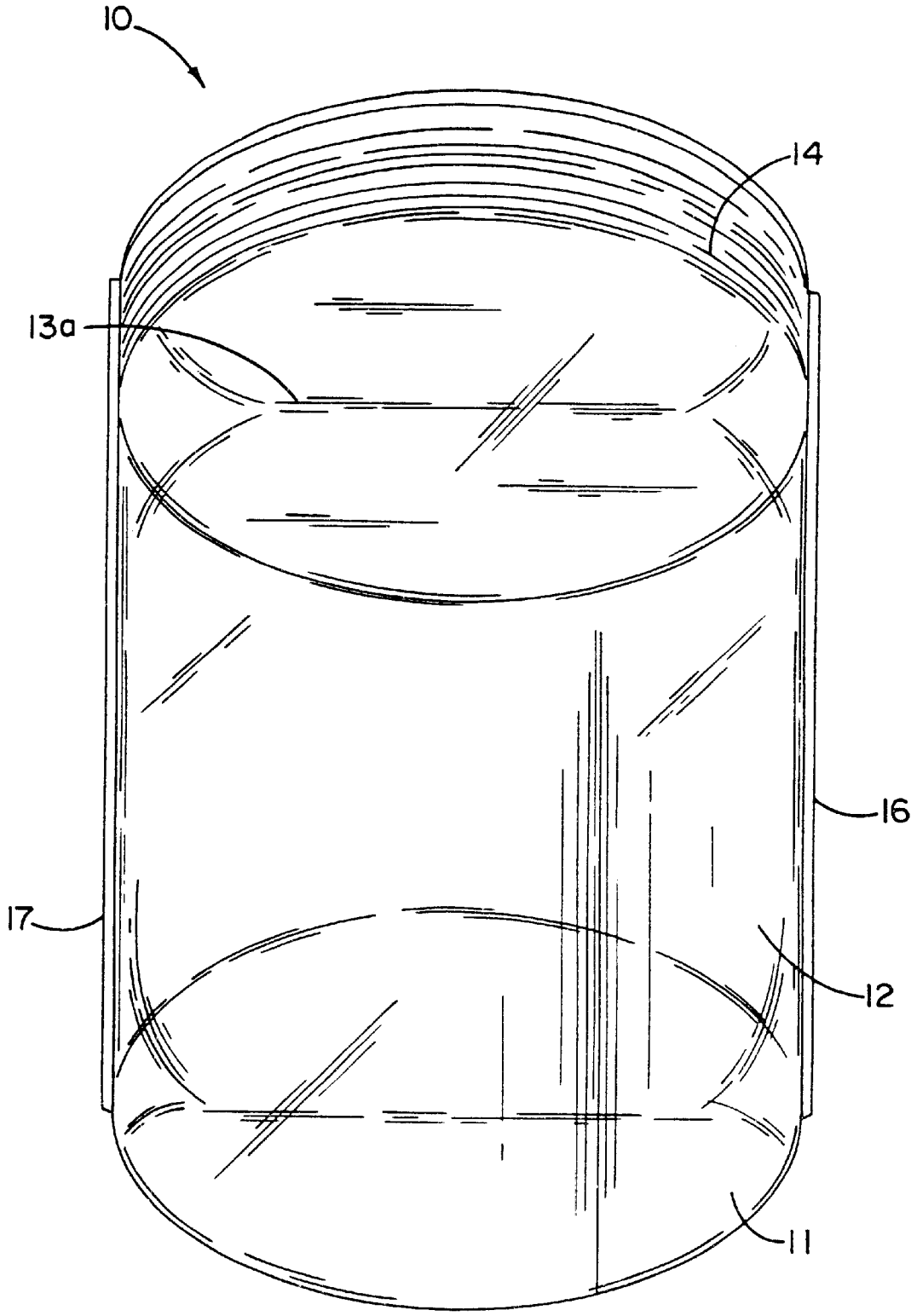
FIG. 1 is a perspective view of a filled bag of the present invention.

FIG. 1 shows a thermoplastic bag B of the present invention. Bag 10 includes opposing sidewalls 11 and 12, an inwardly folded top pleat 13, and a reclosable fastener 14. In the embodiment shown, bag 10 also includes a bottom pleat 15.

Bag 10 can be made from any suitable thermoplastic film such as, for example, low density polyethylene, linear low density polyethylene, substantially linear copolymers of ethylene and a C3–C8 α-olefin, polypropylene, polyvinylidene chloride, mixtures of two or more of these polymers, or mixtures of one or more of these polymers with another thermoplastic polymer.

The thermoplastic film can be any desired thickness. Preferably, the film thickness is greater than about 0.5 mils, more preferably greater than about 0.75 mils, and most preferably greater than about 1.0 mils. Preferably, the film thickness is less than about 10.0 mils, more preferably less than about 7.5 mils, and most preferably less than about 5.0 mils.

Each sidewall 11 and 12 has a top 23, a bottom 25 and two opposing side edges. The tops of the sidewalls form a mouth of the bag 10. The side edges of the sidewalls are sealed together to form side seals 16 and 17. The side seals can be formed by any desired means, such as, for example, impulse sealing, hot wire sealing, hot knife sealing, folding, using an adhesive, or any other desired means. The sidewalls 11 and 12 are also attached to each other along the bottom 25 by any desired means such as, for example, impulse sealing, hot wire sealing, hot knife sealing, folding, using an adhesive, or any other desired means.

An important feature of the present invention is top pleat 13 which is positioned laterally along the width of at least one of the sidewalls 11. Preferably, top pleat 13 is positioned proximate to the top of sidewall 11. "Proximate to the top" of a sidewall is defined herein as meaning closer to the top of the sidewall than to the bottom.

Top pleat 13 is simply an inward fold extending laterally across the width of the sidewall 11. Top pleat 13 is an inward fold as opposed to an outward fold, meaning it forms a pocket inside the sidewall 11, as opposed to a flap which would stick out of the sidewall. The top pleat 13 enables the sidewall 11 to expand outwardly farther than the sidewall 11 could expand without the fold. Thus, when the bag is filled the inside crease of top pleat 13 becomes the centerline of the bag, as opposed to the fastener 14. In this manner, the reclosable fastener 14 is offset, when the bag is filled, as opposed to being disposed along the centerline of the mouth of the bag.

Figure 4A:
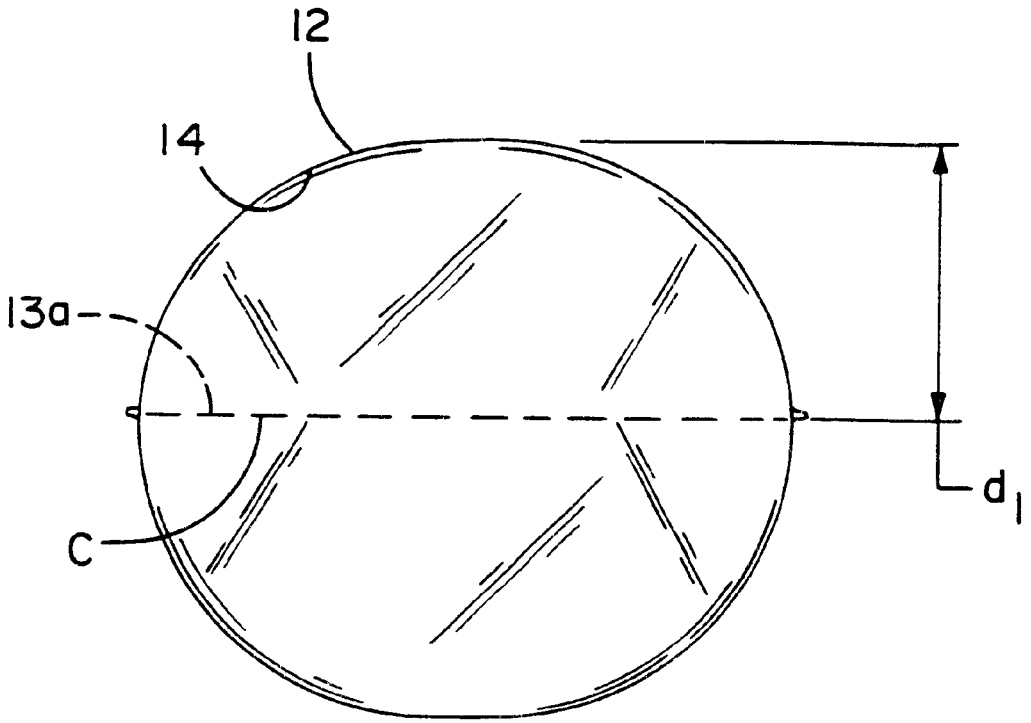
FIGS. 4A and 4B are top views of bags embodying the present invention.
Figure 4B:
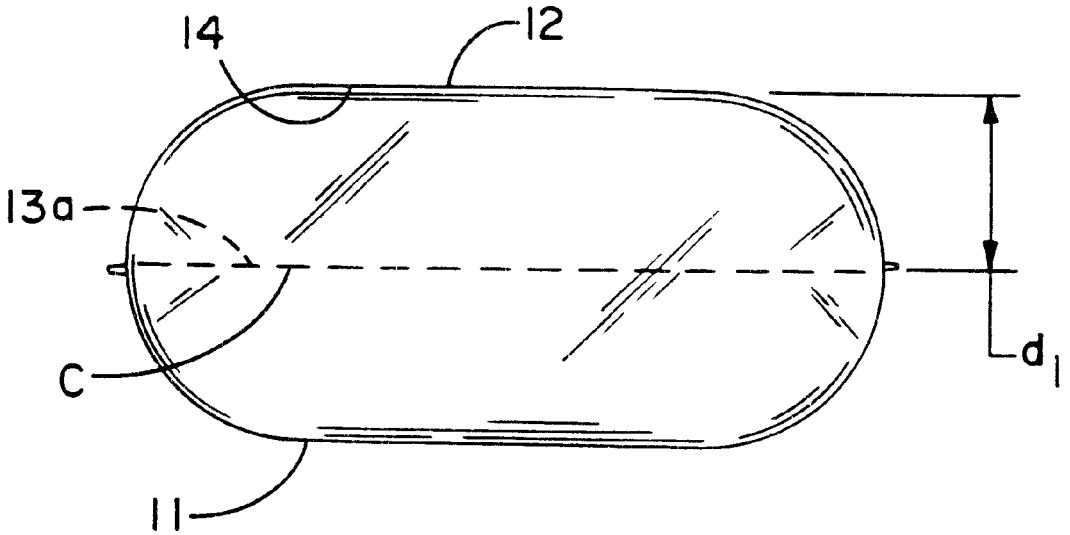

FIGS. 4A and 4B illustrate top views of the offset fasteners of the present invention. The dashed lines in FIGS. 4A and 4B depict what is defined herein as the centerline of the mouth of the bag. As shown, the reclosable fastener 14 does not extend along the centerline of the mouth of the bag; rather, the reclosable fastener 14 is offset, such that it is positioned along the perimeter of the bag when the bag is filled.

Top pleat 13 can be any desired depth. The depth of the top pleat 13, $d_1$, is defined herein as being the distance between the bottom of the reclosable fastener 14 and the fold. Advantageously, $d_1$ is a maximum of ¼ times the width of the bag, w. The width of the bag, w, is defined herein as the distance from one side seal 16 of the bag to the other side seal 17.

Figure 6:
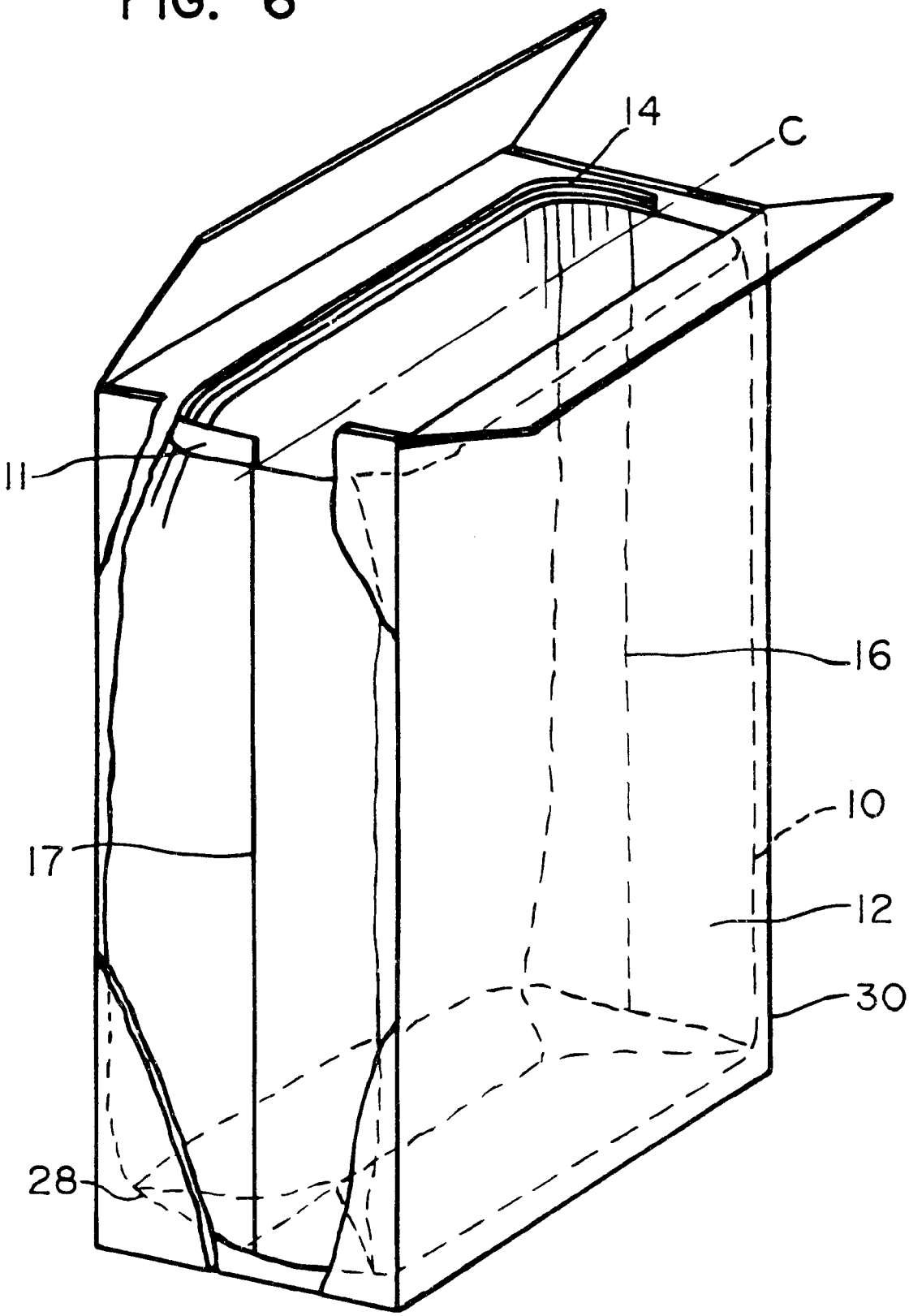
FIG. 6 is embodiment of a bag constructed in accordance with the teachings of the prescnt invention implemented as a liner in a cereal box.

Varying the depth, $d_1$, of the top pleat 13 will change the shape of the filled bag. For example, a relatively deep pleat will result in a elliptically shaped bag when viewed from the top, as in FIG. 4A. On the other hand, a relatively shallow pleat will result in more of a long, rectangular shape when viewed from the top, as in FIG. 4B. Thus, selection of the appropriate $d_1$ depends on the desired shape for the ultimate end use of the bag. Advantageously, when a bottom pleat is incorporated into the bag, the depth of the bottom pleat 15, $d_2$, is equal to $d_1$. In this manner, the shape of the bag will be uniform from top to bottom. The bag can be cylindrical such that it is an effective storage bag for bread and the like; or the bag can have squared corners 28 such that it is an effective liner for a cereal box 30 and the like, as shown in FIG. 6.

Figure 2:
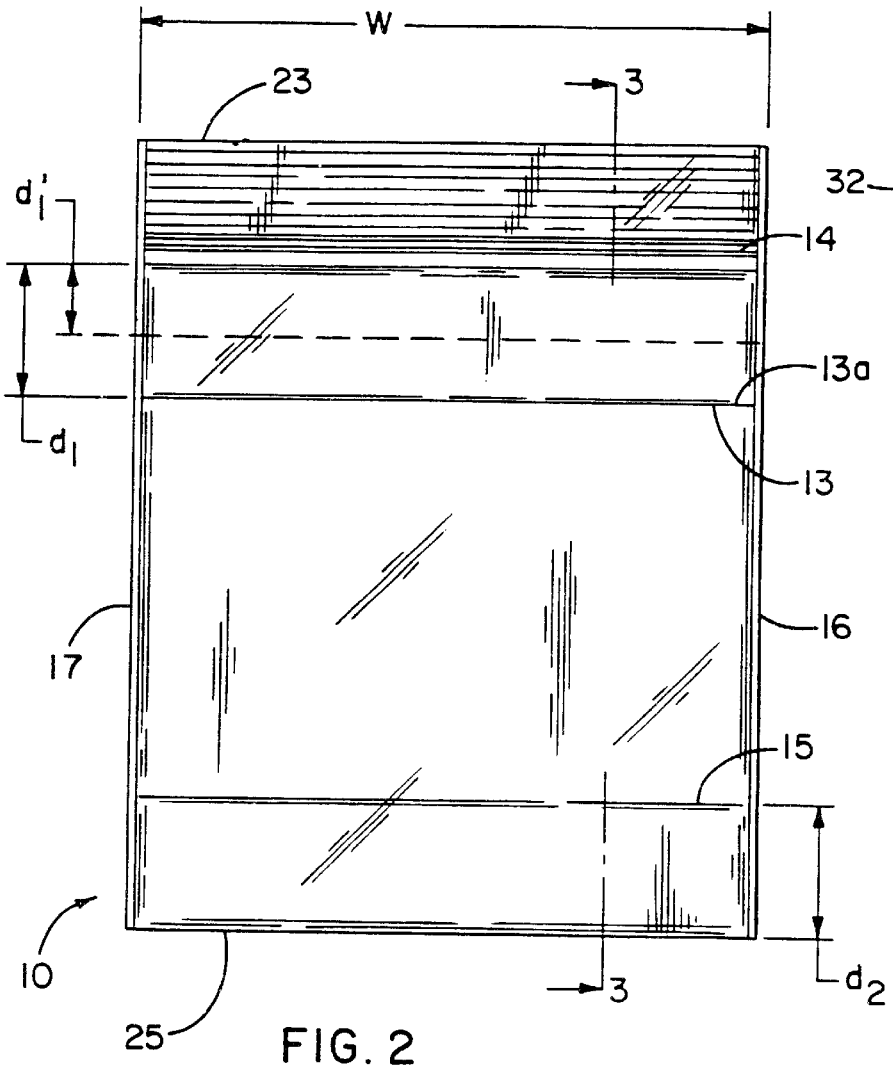
FIG. 2 is a front plan view of a bag of the present invention.
Figure 3:
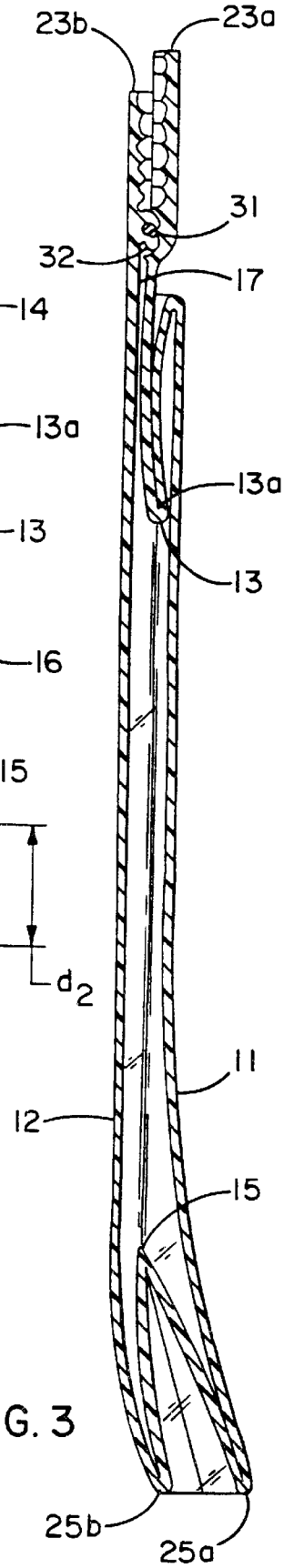
FIG. 3 is a cross sectional view of a bag taken along line 3—3 of FIG. 2, showing top and bottom pleats embodying the present invention.

Reclosable fastener 14 is positioned along the width of bag 10 proximate to the top of bag 10. The reclosable fastener is positioned closer to the top 23 of the bag than top pleat 13, such that the reclosable fastener is positioned between top pleat 13 and the top 23 of the bag when the bag is flat as in FIG. 2.

Figure 5:
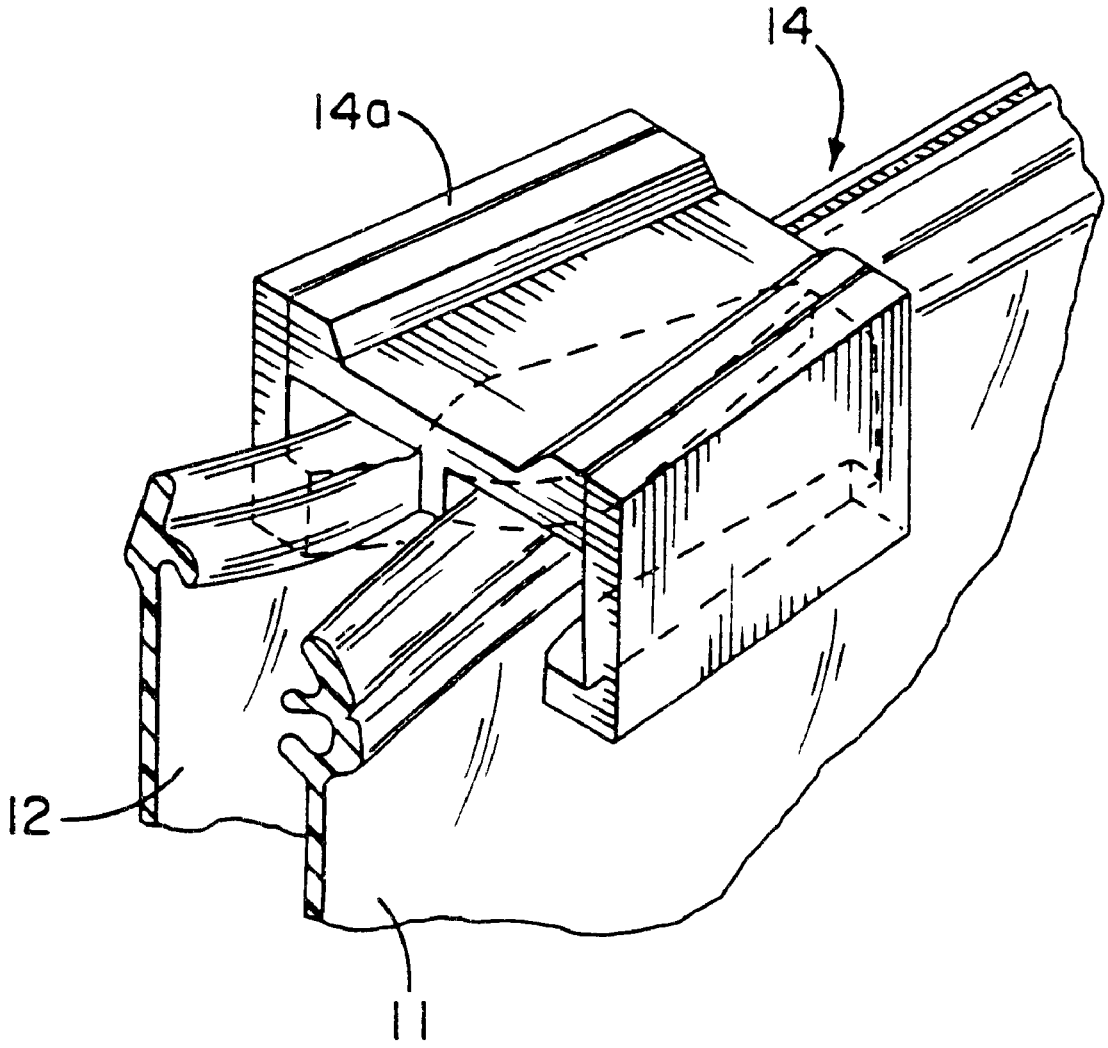
FIG. 5 is an enlarged fragmentary perspective view of an alternative releasable fastening system employing a slider.

Reclosable fastener 14 can be any desired type of fastener, such as, for example, a plastic zipper, a plastic zipper with a slider, an adhesive fastener, VELCRO, snaps, or any other type of reclosable fastener. Preferably, reclosable fastener 14 is a plastic zipper having cooperating closure elements, such as, for example, rib and groove elements as described in U.S. Pat. No. 5,140,727, rolling action closure elements as described in U.S. Pat. No. 5,007,143, or U-shaped closure elements with interlocking hooks as described in U.S. Pat. No. 4,747,702. Furthermore, if desired, the fastener can include a slider 14*a* which travels along the fastener and is adapted to open or close the fastener, such as, for example, those described in U.S. Pat. No. 5,070,583 (an example of which is shown in FIG. 5) and U.S. Pat. No. 5,007,142.

The reclosable fastener 14 may be extruded separately and attached to the sidewalls 11 and 12 of the bag or it may be extruded integrally with the sidewalls of the bag. The sidewalls and the reclosable fastener of the present invention can be made using methods well known in the art, such as, for example, by blow or cast extrusion.

The bag of the present invention can be made using a sheet of film with a reclosable fastener disposed along the width of the sheet of film. Preferably, the sheet of film is folded so as to form two layers of film with the reclosable fastener positioned at one end of the layers of film. The bag of the present invention is preferably made by inwardly folding a portion of one of the layers of film proximate to the fastener to form a top pleat; sealing the two layers of film together transversely to the top pleat to form a first side seal; sealing the two layers of film together transversely to the top pleat at a distance w from the first side seal to form a second side seal. Preferably, the method also includes inwardly folding at least one of the layers proximate to the bottom edge to form a bottom pleat.

Both the top and bottom pleats can be formed using such methods as described in U.S. Pat. Nos. 5,246,416, 5,186,707, 5,083,999, 5,147,278, incorporated herein by reference.

EXAMPLE

A thirty-inch film is formed using standard cast-film equipment. The film includes a rib-and-groove type of plastic zipper such that the rib element is at one end of the film and the groove element is at the other end of the film. The film is folded in half such that two layers of film are formed, one layer having the rib element at a mouth end of the layer, the other layer having the groove element at a mouth end. The rib and groove elements are positioned such that they may interlock with each other. The fold between the two layers is the bottom edge of the bag.

A top pleat is formed by inwardly folding one of the layers to a depth $d_1$ of 2.5 inches (6.35 cm). A bottom pleat is then formed by inwardly folding at the bottom edge to a depth $d_2$ of 2.5 inches (6.35 cm). The two layers are then impulse sealed together transversely to the rib and groove closure elements at a distance 10 inches (25.4 cm) apart.

What is claimed is:

1. Apparatus for packaging materials, said apparatus comprising:

a container defining an internal volume of a given configuration; and an expandable liner having a configuration that substantially conforms to the configuration of the container when the liner is in an expanded condition, said liner comprising:

a reclosable bag having a pair of opposed walls joined along a common bottom edge and along common side edges thereof, said bag having adjacent top edges providing a mouth for the bag, the mouth extending from one side edge to the other side edge to provide unimpeded access for filling the bag from the top thereof; reclosable fastening members adjacent to the top edges and extending laterally between the side edges of the bag, said fastening members being selectively joinable to close the mouth of the bag, at least one of the walls having an inwardly folded expandable top pleat section extending from one of the side edges, said bag further including a bottom pleat having a centerline defined by the common bottom edge, said top pleat and bottom pleats being expandable to thereby displace the reclosable fastening members from an initial position centrally between the walls when the bag is in a collapsed position to an offset position when the bag is in an expanded condition in which the reclosable fastening members are bowed outwardly from said initial position, said top pleat and bottom pleat having relative depths chosen to provide the bag with a given configuration which substantially conforms to the configuration of the container when the bag is in the expanded condition.

2. The apparatus of claim 1 wherein the top pleat has a predetermined depth $d_1$, said bottom pleat has a depth $d_2$, and wherein $d_1$ is substantially equal to a depth $d_2$.

* * * * *